US005135170A

United States Patent [19]

Takeda et al.

[11] Patent Number: 5,135,170

[45] Date of Patent: Aug. 4, 1992

[54] CLEANING NOZZLE

[75] Inventors: Shigeki Takeda, Takaishi; Kazuma Arikawa, Nishinomiya, both of Japan

[73] Assignee: Kabushiki Kaisha Arikawa Seisakusho, Takarazuka, Japan

[21] Appl. No.: 674,018

[22] Filed: Mar. 25, 1991

[30] Foreign Application Priority Data

Sep. 26, 1990 [JP] Japan ..... 2-257875

[51] Int. Cl.[5] ..... B05B 3/10

[52] U.S. Cl. ..... 239/205; 239/204; 239/206; 239/251

[58] Field of Search ..... 239/203-206, 239/DIG. 13, 227, 251; 134/176, 179

[56] References Cited

U.S. PATENT DOCUMENTS

| | | | |
|---|---|---|---|
| 1,058,549 | 4/1913 | Cathcart | 239/204 |
| 1,259,902 | 3/1918 | Parker | 239/204 |
| 1,428,553 | 9/1922 | Oakes | 239/204 |
| 1,995,962 | 3/1935 | Clark | 239/203 |
| 2,125,863 | 8/1938 | Arbogast | 239/204 |
| 2,493,982 | 1/1950 | Lee | 239/DIG. 13 |
| 3,454,225 | 7/1969 | Hunter | 239/205 |
| 3,804,338 | 4/1974 | Williams, 3rd et al. | 239/203 |
| 4,466,142 | 8/1984 | Gould | 239/204 |
| 4,781,327 | 11/1988 | Lawson et al. | 239/203 |
| 4,986,474 | 1/1991 | Schisler et al. | 239/205 |
| 5,005,767 | 4/1991 | Heren | 239/205 |

FOREIGN PATENT DOCUMENTS

| | | | |
|---|---|---|---|
| 2914797 | 10/1979 | Fed. Rep. of Germany | 239/204 |
| 1280269 | 12/1986 | U.S.S.R. | 239/203 |
| 1350211 | 4/1974 | United Kingdom | 239/204 |

*Primary Examiner*—Andres Kashnikow
*Assistant Examiner*—Lesley D. Morris
*Attorney, Agent, or Firm*—Nikaido, Marmelstein, Murray & Oram

[57] ABSTRACT

The cleaning nozzle of the invention is intended to clean the parts to be cleaned by the cleaning water, by feeding cleaning water into the cylinder tube, pushing out the injection nozzle from the mounting surface by the pressure of the cleaning water, and injecting cleaning water while rotating at the same time. Next, when the feed of cleaning water is stopped, the injection nozzle stops injecting cleaning water, and is simultaneously retracted into the housing, thereby closing the mounting part by the poppet valve.

2 Claims, 2 Drawing Sheets

CLEANING NOZZLE

BACKGROUND OF THE INVENTION

The present invention relates to a cleaning nozzle used in automatic cleaning of inside of particulate material manufacturing equipment, tanks, chutes or the like in high temperature water or other fluid.

Hitherto, various cleaning nozzles of this sort have been known, for example, the cleaning nozzle for rotating a rotary element assembled in a cylinder by the fluid flow flowing in the cylinder connected to a cleaning fluid feed pipe, and injecting the cleaning fluid from an injection pipe while swiveling the injection pipe through a reduction gear train by rotation of this rotary element, the cleaning nozzle for injecting the cleaning fluid from the injection pipe while forcing to swivel the injection pipe assembled in the lower part of the cylinder, by driving motor mounted on the upper part of the cylinder, through a drive shaft penetrating through the inside of the cylinder, and the cleaning nozzle for rotatably disposing the injection pipe arranged on the circumference centered around the axial center of the cylinder, and rotating the injection pipe around the axial center of the cylinder by the reaction force of the jet flow injected from the injection pipe.

In these conventional cleaning nozzles, the mechanism is complicated or increase in size by the reduction gear train, and compressed air and electric power are required aside from the cleaning fluid. Above all, the greatest demerit of the conventional cleaning nozzles is that the nozzle main body is clogged with the particulate material when treating the particulate material inside the particulate manufacturing equipment, tank or chute because it is installed in the projected state inside the particulate manufacturing equipment, tank or chute, possibly resulting in inability of rotation mechanically, inability of cleaning when cleaning, inability of stable operation of the equipment due to closure or sticking phenomenon of particulate material by the cleaning nozzle, or decrease of production capacity or lowering of product quality as the case may be. Accordingly, in the general conventional method of cleaning the inside of the particulate manufacturing equipment, tank, chute or the like, opening the cleaning port by hand, the conventional cleaning nozzle or hose was put in to clean the inside, or otherwise the equipment was forced to be disassembled into individual components to be cleaned by hand. Therefore, when cleaning many parts or cleaning hardly accessible places, it took much labor and time, accompanied by danger, and also raised the cleaning cost and caused fluctuations in the cleaning effect and cleaning quality. Furthermore, human errors were likely to be induced, and especially in manufacturing facilities of pharmaceuticals, foods and the like, it is difficult to minimize the contamination and quality changes of pharmaceuticals, foods and others. To prevent them, in each manufacturing line unit, and in each machine, or also in each manufacture if necessary, it may be considered to control sequentially by programming the cleaning cycle [for example, 1. primary washing in tap water (cleaning with detergent, 2. finish washing by deionized water or distilled water, 3. drying by hot air], and cleaning conditions [for example, 1. washing pressure, 2. washing temperature, 3. washing speed, 4. hot air temperature, 5. washing time or water volume, 6. hot air drying time, etc.]. There has been, however, hindrance to full automation of cleaning system that can save the cleaning fluid, use in the night time, enable unmanned operation, and contribute greatly to enhancement of labor-saving and productivity.

SUMMARY OF THE INVENTION

It is hence a primary object of the invention to present means for solving the above problems noted in these conventional nozzles. In order to achieve this object, the invention presents a cleaning nozzle comprising a cylinder tube in an internal tubular form, having a piston slidably inserted inside, and a piping opening for connection of cleaning water feed pipe provided at the rear end thereof, and also having a rod cover possessing an internal stopper for defining the forward position of the piston inserted and fixed inside the front end part thereof, a hollow piston rod slidably inserted in the rod cover and integrally affixed to the piston, a pressure spring compressed and placed between the piston and rod cover, and always pulling the piston rod rearward, an injection nozzle affixed to the front end of the piston rod, and injecting cleaning water while rotating by the injection pressure of the cleaning water itself, and a poppet valve affixed to the front end of the injection nozzle, and closing flush a front end opening part of a cylindrical housing extended and mounted on the front end of the cylinder tube by the pressure spring.

In the cleaning nozzle of the invention, by injecting the cleaning water into the cylinder tube, the injection nozzle is pushed out of the mounting plane by the pressure of the cleaning water, and injects the cleaning water while rotating, thereby cleaning the necessary parts by the cleaning water. When feed of cleaning water is stopped, the injection nozzle stops injecting the cleaning water, and is at the same time retracted into the housing, thereby closing the mounting part by the poppet valve.

DESCRIPTION OF THE PREFERRED EMBODIMENT

Figure 1:
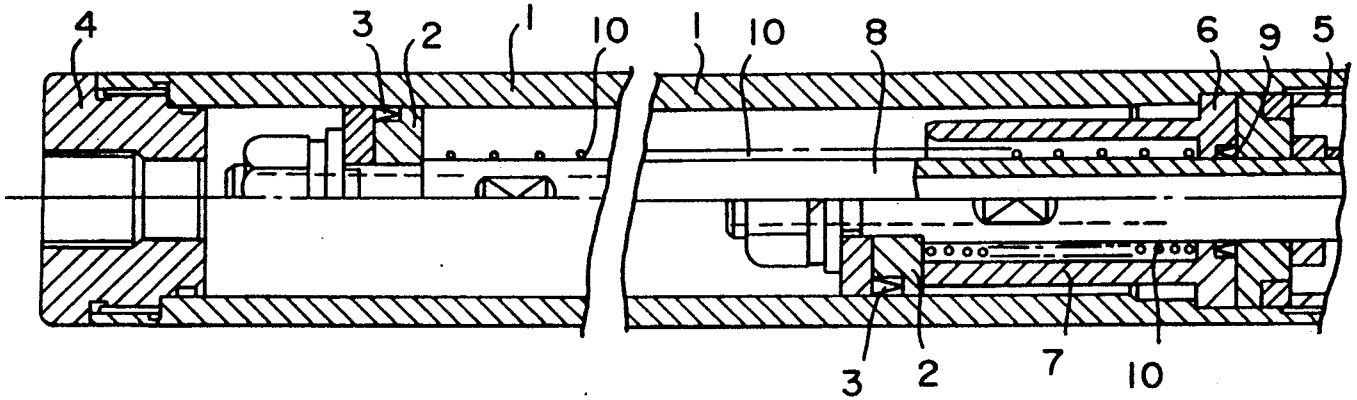
FIG. 1 is a longitudinal sectional view of rear parts of the cleaning nozzle of the invention, showing the non-cleaning time in the top and the cleaning time in the bottom.
Figure 2:
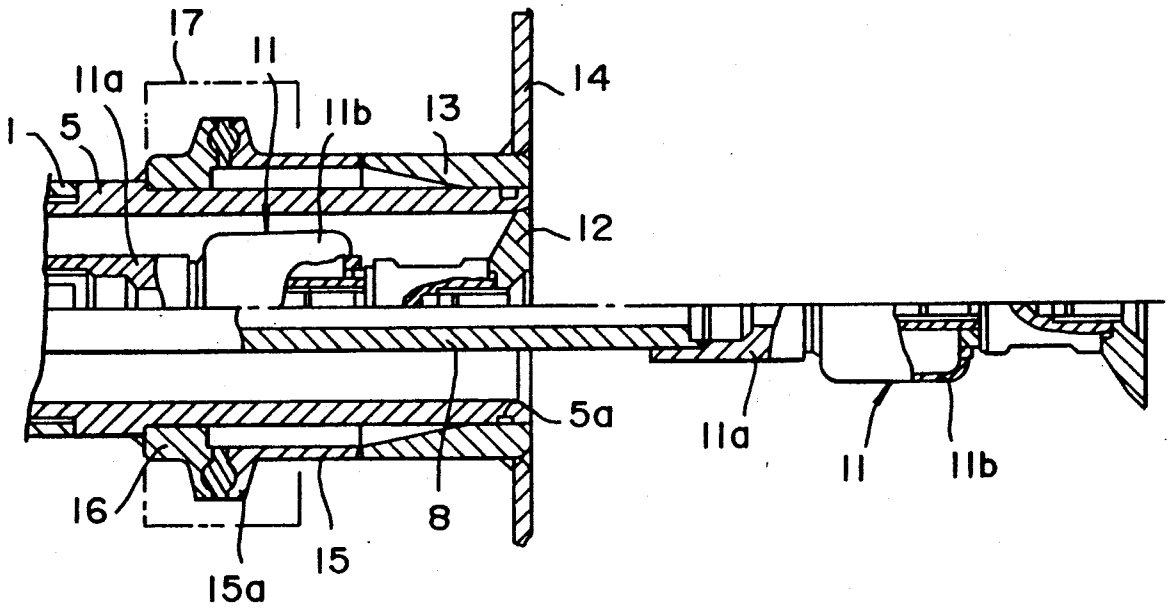
FIG. 2 is a longitudinal sectional view of front parts of the cleaning nozzle of the invention, showing, same as in FIG. 1, the non-cleaning time in the top and the cleaning time in the bottom.

In FIG. 1 and FIG. 2, numeral 1 is a cylindrical cylinder tube having a piston 2 slidably inserted inside by way of a seal member 3, and a piping opening 4 for connection of cleaning water feed pipe is screw-fitted to the rear end part (the left end part in FIG. 1), and a cylindrical housing 5 is screw-fitted to the front end part (the right end part in FIG. 2), and an expanding valve seat 5*a* is formed at the front end face of this housing 5. Numeral 6 is a rod cover inserted and fixed inside of the front end of the cylinder tube 1, and an interval stopper 7 in a cylindrical form is integrally formed at the rear end face, and the forward position of the piston 2 is defined as the piston 2 abuts against this internal stopper 7. Therefore, the forward position of the piston 2 may be adjusted by varying the length of the internal stopper 7. Numeral 8 is a hollow piston rod slidably inserted in the rod cover 6 by way of a seal member 9, and the piston 2 is integrally affixed to its rear end part, and it moves back and forth together with the piston 2. Numeral 10 is a pressure spring compressed and placed between the piston 2 and the rod cover 6, and it always pulls backward the piston rod 8 through the piston 2. Numeral 11 is an injection nozzle mounted on the front end of the piston rod 8, and a rotary head 11*b*, although not shown, forming multiple slits toward the tangential direction in the outer circumferential surface is rotatably disposed on a feed pipe 11*a* of the injection nozzle 11, and the cleaning water flowing into the feed pipe 11*a* from the piping opening 4 through the piston rod 8 is injected from the slits in the rotary head 11*b* toward the tangential direction, and the nozzle 11 is rotated in the reverse direction of the injection direction of the cleaning water by the reaction of the cleaning water injected from the slits. Numeral 12 is a poppet valve affixed to the front end of the injection nozzle 11 concentrically with the housing 5, and it is pulled backward by the pressure spring 10 through piston 2, piston rod 8 and injection nozzle 11 and is pressed tightly against the valve seat 5*a* of the housing 5 to be flush with the front end face of the housing 5, and the front end opening of the housing 5 is closed at the same time. Numeral 13 is a cylindrical tube stand affixed on an outer wall 14 of particulate manufacturing equipment, tank, chute or the like so that its inner face and its front end face may be flush with the outer wall 14, and a cylindrical sleeve 15 is fused butt to butt to the rear end, and a mounting flange 15*a* is integrally formed at the rear end of this cylindrical sleeve 15. Numeral 16 is a mounting flange affixed on the outer circumferential surface of the housing 5, and the housing 5 is inserted into the tube stand 13 and cylindrical sleeve 15 so that its front end face may be flush with the front end face of the tube stand 13, and by fitting into the mounting flange 15*a* of the cylindrical sleeve 15 through a clamp 17, the cylinder tube 1 and housing 5 are attached to the outer wall 14.

The action of the cleaning nozzle of the invention composed as specified herein is described below.

At the time of cleaning, when cleaning water with a specific pressure is fed from the piping opening 4 into the cylinder tube 1, the piston 2 moves forward, resisting the pressure spring 10 by the pressure of the cleaning water, and the injection nozzle 11 and poppet valve 12 are pushed out from the front end face of the housing 5 through the piston rod 8, and the cleaning water is simultaneously passed into the injection nozzle 11 through the piston rod 8, and the injection nozzle 11 injects cleaning water while rotating. At this time, the injection nozzle 11 is inserted inside of the particulate manufacturing equipment, tank, chute or the like in a stroke until the piston 2 abuts against the internal stopper 7, and the cleaning parts, that is, the inside parts of the outer wall 14 are cleaned by the cleaning water injected from the slits.

After the lapse of the time for cleaning the inside of the outer wall 14, when the feeding of cleaning water into the cylinder tube 1 from the piping opening 4 is stopped, the injection of cleaning water by the injection nozzle 11 is stopped, and the piston 2 is simultaneously drawn back by the pressure spring 10, and then the injection nozzle 11 and poppet valve 12 are retracted into the housing 5 through the piston rod 8, and the poppet valve 11 presses against the valve seat 5*a* of the housing 5, thereby closing the front end opening part of the housing 5.

Afterwards, when the compressed air for purging is fed from the piping opening 4 into the cylinder tube 1, same as when the cleaning water is fed mentioned above, the injection nozzle 11 and poppet valve 12 are pushed out by the pressure of the compressed air until the piston 2 abuts against the internal stopper 7, and the injection nozzle 11 injects the compressed air while rotating at the same time. As a result, the residual cleaning water is purged by the compressed air to dry the inside of the equipment completely.

After the time for drying the inside completely, when the supply of compressed air for purging from the piping opening 4 into the cylinder tube 1 is stopped, same as when the feed of cleaning water is stopped above, the injection nozzle 11 stops injection of compressed air, and the injection nozzle 11 and poppet valve 12 are retracted into the housing 5, and the front end opening part of the housing 5 is closed by the poppet valve 12. Then, the particulate manufacturing equipment, tank, chute or the like will treat the particulate material.

Meanwhile, the invention is not limited to the above embodiment alone, and, for example, the poppet valve 12 and the valve seat 5*a* of the housing 5 may contact with a spherical surface, or by varying the length of the internal stopper 7, the stroke of the injection nozzle 11 may be adjusted, and furthermore by varying the slit shape, dimensions, number of slits and other conditions of the injection nozzle 11, the optimum cleaning condition for the object to be cleaned may be obtained.

As described herein, the cleaning nozzle of the invention is not projecting from the inside of the equipment mounting part while not cleaning, and the equipment mounting part is completely closed by the poppet valve, and since the inside of the equipment mounting part is flat, the movement of the particulate material is not impeded even when the particulate material is treated, and problems of contamination and others may be avoided.

In addition, other power is not needed, and the operation completely depends on the pressure of the cleaning water or compressed air for purging, it is only enough to control the automatic valve by on/off switching in controlling, and normal and reverse actions, and detection of position are not necessary. Therefore, the control is very easy, and hence human errors are hardly induced.

Besides, since the injection nozzle is rotated by the injection pressure of the cleaning water itself when cleaning, it is possible to feed in all directions of 360 degrees.

It is also possible to purge by compressed air, and by purging with a proper pressure after cleaning, leak of cleaning water in operation of the manufacturing equipment is avoided.

When SUS and Teflon are used in the materials of the parts in contact with liquid, high temperature water close to boiling water which was dangerous in the conventional manual cleaning can be used, and the cleaning effect is high.

When operated automatically in a predetermined method by the sequencer or the like, together with other plural cleaning nozzles, a cleaning effect of an always constant level may be obtained as compared with the conventional manual cleaning.

By automatic operation, the cleaning equipment may be installed in a place which is not easily accessible by the workers.

What is claimed is:

1. A cleaning nozzle for cleaning the inner parts of an outer wall of particulate manufacturing equipment, a tank, a chute, or the like, especially used in manufacturing facilities of pharmaceutical or foods, comprising:

a cylinder tube having an internal tubular form having a front end, and a rear end with a piping opening for connection of a cleaning water pipe thereto;

a cylindrical housing extended and mounted on the front end of said cylinder tube, said housing having a front end opening part opening to said outer wall and flush with the inner parts of said outer wall, said front end opening part providing a valve seat therewith tapering outwardly in the direction of said outer wall;

a piston slidably inserted inside said cylinder tube, said piston having a seal member sealing a clearance between said piston and said cylinder tube;

a rod cover fixed inside of said cylinder tube and situated forwardly of said piston, said rod cover having a stopper for defining a forward position of said piston;

a hollow piston rod slidably inserted in said rod cover and integrally fixed to said piston;

a pressure spring compressed and placed between said piston and said rod cover, and always pulling said piston rod rearwardly;

an injection nozzle, having a front end, affixed to a front end of said piston rod, for injecting cleaning water, while rotating, by an injection pressure of cleaning water fed to said cylinder tube through said piping; and a poppet valve affixed to the front end of said injection nozzle, pressed tightly against said valve seat when said poppet valve is closed and closing flush with the front end opening part of said housing by said pressure spring whereby, in the absence of cleaning water pressure against said piston, said poppet valve and said front end opening part of said housing are flush with the inner parts of said outer wall.

2. A cleaning nozzle as defined in claim 1, wherein said means for affixing said cylindrical housing on said front end of said cylinder tube outer wall comprises a cylindrical sleeve affixed to an outer wall, of said cylinder tube into which said cylindrical housing wall is inserted, having a mounting flange thereon, a mounting flange affixed to said cylindrical housing, and means for securing said mounting flange of said cylindrical housing to said mounting flange of said cylindrical sleeve.

* * * * *